United States Patent [19]

Nakaoka et al.

[11] 4,026,729

[45] May 31, 1977

[54] METHOD OF MAKING A SOFT STEEL SHEET BY CONTINUOUS ANNEALING

[75] Inventors: Kazuhide Nakaoka; Kenji Araki, both of Yokohama; Takayoshi Shimomura, Fukuyama; Haruo Kubotera, Yokohama; Shinobu Osaka, Fukuyama; Nobuo Tanaka, Fukuyama; Hiroshi Kuroda, Fukuyama; Takao Kurihara, Yokohama, all of Japan

[73] Assignee: Nippon Kokan Kabushiki Kaisha, Tokyo, Japan

[22] Filed: Nov. 17, 1975

[21] Appl. No.: 632,570

[30] Foreign Application Priority Data

Dec. 5, 1974 Japan ..... 49-138844

[52] U.S. Cl. ..... 148/12.4; 148/12 C; 148/12 F

[51] Int. Cl.[2] ..... C21D 7/14

[58] Field of Search ..... 148/12 C, 12 F, 12.4

[56] References Cited

UNITED STATES PATENTS

| | | | |
|---|---|---|---|
| 2,377,922 | 6/1945 | Campbell et al. | 148/12 C |
| 2,666,722 | 1/1954 | Epstein et al. | 148/12 C |
| 3,513,036 | 5/1970 | McFarland et al. | 148/12 C |
| 3,560,270 | 2/1971 | Reinbold et al. | 148/12 C |
| 3,716,420 | 2/1973 | Matsudo et al. | 148/12 C |
| 3,806,376 | 4/1974 | Toda et al. | 148/12 C |
| 3,814,636 | 6/1974 | Mould et al. | 148/12 C |
| 3,879,232 | 4/1975 | Gondo et al. | 148/12 C |

FOREIGN PATENTS OR APPLICATIONS

| | | | |
|---|---|---|---|
| 1,168,636 | 10/1969 | United Kingdom | 148/12 C |

*Primary Examiner*—Arthur J. Steiner
*Attorney, Agent, or Firm*—Moonray Kojima

[57] ABSTRACT

In a process of making a cold-reduced steel strip for press-forming by a continuous annealing process comprising a rapid cooling step after recrystallization heating and an over-aging treatment step, when no spray of cooling water at the runout table before coiling in the hot-rolling stage is carried out on the top side and the bottom side of a travelling hot-rolled steel strip by about 20 to 200m respectively, a cold reduced soft steel sheet for press-forming is easily obtained by the above continuous annealing process.

1 Claim, 3 Drawing Figures

METHOD OF MAKING A SOFT STEEL SHEET BY CONTINUOUS ANNEALING

The present invention concerns an improvement in the manufacture of a cold reduced soft steel strip for press-forming by a continuous annealing process, and more particularly it offers a method of giving a uniform quality over the whole length of strip by not cooling the two end sides of a hot-rolled strip and then coiling it at a high temperature in its hot rolling stage.

For those engaged in the researches of cold reduced steel sheets, it was a dream for many years to develop a continuous annealing art which would enable manufacture of a cold reduced soft steel strip for press-forming. Recently, an art of this kind has been developed and already put into practice in Japan. This leads to a rapid diffusion of the said art on a world wide scale. Such continuous annealing arts are disclosed in Japanese Patent Publication 49-1969, Japanese Patent Lay-open print 49-22330, Japanese Patent Lay-open print 49-24829, and Japanese Patent Lay-open print 49-35218. The arts disclosed therein have unique features of their own with the details differing. They are characterized by the following common features.

1. The material is either low carbon rimmed steel or low carbon Al-killed steel.
2. In the hot rolling stage, the strip is coiled at a temperature of above 630° C.
3. The heat cycle in the continuous annealing is a short-period, overaging cycle comprising short-period overaging — cooling down to the room temperature in order to perform "recrystallization reheating — rapid cooling — precipitation of C".

It was aimed by combining these functions to obtain soft steel sheet for press forming. Continuous annealing process for a cold reduced steel strip has advantages which are not available by the ordinary batch type annealing process. Such advantages are; high productivity, saving of labor and uniformity of quality. However the continuous annealing process is used universally, and even the improved process as above mentioned for that matter, is known to produce a strip of which quality is not so uniform. The uneven parts appear at the top side and bottom side of strip. It is self-evident that these defective parts extend considerably and they naturally lower the yield. That the top side and bottom side of the strip are inferior compared to the middle part radically reduces advantages of the above mentioned continuous annealing process, and it is naturally not preferable from a point of quality control at a work. Unfortunately, there has not been any effective and suitable means available to obviate such a defect.

The present invention was contrived with a view to solve these difficulties and is characterized in that cooling on run-out table for a travelling hot-rolled steel strip was improved that is, no spray of cooling water on the run-out table before coiling is carried out on the top side and bottom side of a travelling hot-rolled steel strip by about 20 to 200m respectively and then the strip is coiled at a temperature of above 630° C.

An object of this invention is to provide an improved method for quality of the both end sides of continuously annealed strip, which tends to deteriorate by a continuous annealing process.

Another object of this invention is to provide an improved method being possible to perfectly exhibit the advantages of the continuous annealing process.

Other objects and advantages of this invention will be apparent from the following description and with the accompanying drawings in which.

Figure 1:
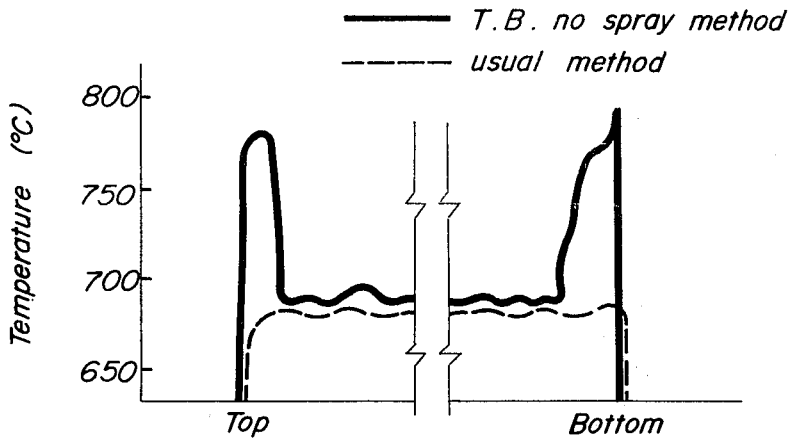
FIG. 1 is one of patterns of coiling temperature by the usual method and this invention method.

The developing of this invention is based on an information that the reason for showing mechanical properties of the both end sides of a continuously annealed strip being inferior to that of its middle portion, which is ought to be uniformalized over the whole length by a continuous annealing process, lies in the cooling manner for a travelling hot rolled steel strip preceding the continuous annealing process, not in the continuous annealing itself. In the ordinary hot rolling process, the strip having passed through the last stand is cooled by spray of water on the run-out table to obtain to a required temperature and is coiled. It is known well that the cooling effect in such an instance is not entirely uniform for the whole length of the said travelling strip. Self-annealing effect of the coil caused by the coiling temperature acts to relieve the said uneveness, but this effect was confirmed not to extend to a considerable length of the inner and outer peripheries of the said coil i.e. the top and bottom side (T.B. portion) of strip. This truly bears a grave significance. For instance, at the above T, B portion of the rimmed steel strip, carbides in steel have not grown larger or they have become pearlite structure even if they have grown. Or in the case of low carbon Al-killed steel, precipitation of AlN in steel remains fine. Such trends are brought over to the following cold reduced stage and are not relieved in the final stage of continuous annealing because of an extremely short heat cycle. As a result, the said T.B. sides of strip obtained after continuous annealing showed higher yield point (YP) and lower Lankford value (r) compared to its middle portion. The present situation is such that the defective parts such as this usually extend to 100m – 300m counting the both sides.

For improving such defective the T, B sides of strip, it is considered realistic to compensate them by improving self-annealing effect of coil by the coiling temperature after finish-rolling. One countermeasure is to raise the said coiling temperature to above 630° C. However, this automatically has its limitations. A number of experiments proved that the coiling temperature corresponding to the middle of coil should not exceed 740° C in view of actual operation. Another countermeasure is aggressive annealing, not self-annealing, after coiling. However, this would require an additional furnace, which in turn would invite the higher cost and complication of the process management. Further countermeasure envisaged was to air-cool travelling strip on a run-out table without using cooling water following the finish-rolling. However, it is known that this method accompany various difficulties. For example, a high temperature finish rolling is a prerequisite for obtaining soft steel sheet for press forming by continuous annealing, which is different from a batch type annealing. Accordingly, the said air cooling would unavoidably result in a coiling temperature of 780° – 800° C (we have already discussed the preference for the coiling temperature not exceeding 730° C at the middle of coil). This will naturally lead to deformed coil, bad pickling, and coarse hot rolled grains (bringing about orange peel on product). In view of the above, the present invention coils the strip from the run-out table after it passes through the finishing stand at above 630° C without cooling with spraying of water its T and B sides for the length of about 20 to 200m, that is, spraying only on the middle portion of strip excepting the said length. More concisely, it may be called T.B. NO SPRAY METHOD.

According to the above T.B. NO SPRAY METHOD, the coiling temperature forms a pattern illustrated in FIG. 1. The top side and bottom side of strip corresponding to the inner and outer peripheries of coil become higher than the middle portion and form a shape like a letter M. Such a temperature pattern (FIG. 1) is obtained from strip of 3.2mm thickness after hot rolling with no spray length extending for 30m at the top and 100m at the bottom respectively. Dotted line indicates a pattern of usual high temperature coiling. The lower limit of such a length of NO SPRAY is about 20m while the upper limit thereof is about 200m for the following reasons.

According to a number of experiments carried out, more than about 20m is necessary to utilize the holding effect of coil, whereas the length exceeding about 200m will result in appearance of above mentioned defects of NO SPRAY over the whole length.

Other components of the present invention are the same as those of the general manufacturing method of soft steel sheets for press forming using a continuous annealing process which substantially includes high temperature coiling in hot-rolling stage, and short period overaging. For instance, these are as follows;

Kind of steel: low carbon capped steel, low carbon silicon semi-killed steel or low carbon Al-killed steel and others.

Finishing temperature for hot rolling: at above 800° C

Coiling temperature: at above 630° C

Thickness after hot rolling: 1.2 to 4.5mm

Thickness after cold reducing: 0.2 to 1.6mm

Continuous annealing heat cycle:

Recrystallization temperature; recrystallization heating of 800° C for 30 to 120 sec.

Rapid cooling to below 500° C

Short-period overaging at 350° C to 500° C for 30 to 300 sec.

Final cooling to room temperature

Temper rolling rate: 0.8 to 1.5%

Examples of the present invention are given below. These examples will demonstrate the utility of the present invention in detail.

EXAMPLE 1

This example applies the present invention method to low carbon capped steel and its making process comprises slabbing — hot rolling — pickling — cold reducing — continuous annealing — temper rolling. The requirements employed in the respective step of manufacture were;

Chemical composition of mother material;

| C | Mn | P | S | $O_2$ |
|---|---|---|---|---|
| 0.053 | 0.28 | 0.010 | 0.019 | 0.048 |

-continued

| Requirements for hot rolling | | | |
|---|---|---|---|
| Finishing temperature | 820 to 850° C | | |
| Coiling | Top (T) No spray length | Middle (M) coiling temp. | Bottom (B) No spray length |
| Type I | 0 | 680° C | 0 |
| Type II | 40m | 675° C | 60m |
| Type III | 100m | 680° C | 160m |

Type I is usual high temperature coiling manner while types II and III are in accordance with the present invention.

Finished thickness: 2.8mm

Thickness after cold rolling: 0.8mm Continuous annealing heat cycle 1. heating from the room temperature to 720° C
2. holding for 40 seconds at the above 720° C
3. cooling to 595° C at the average cooling rate of 7° C/sec from the above temperature.
4. quenching with water from the said 595° C to the room temperature
5. reheating up to 490° C
6. cooling from the said 490° C to 350° C at the average cooling rate of 2° C/sec.
7. final cooling from the said 350° C to the room temperature at the average cooling rate of 5° C/sec.

Temper rolling: 1%

Figure 2:
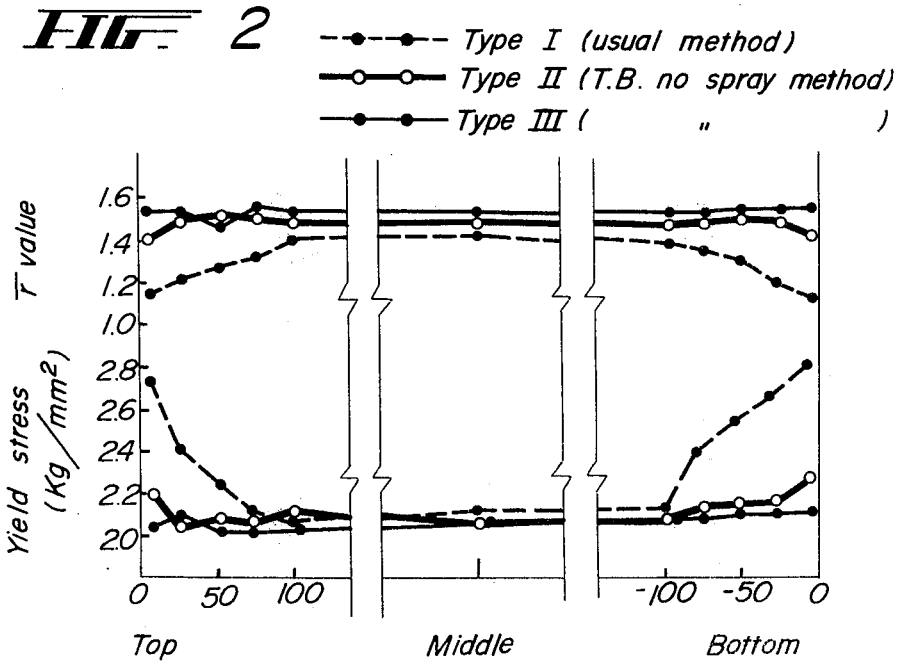
FIG. 2 shows a graph showing the relation between cooling methods and behavior of quality of a low carbon capped steel strip end sides thereby.

FIG. 2 shows the relation between behavior of the coil end sides under the above process and the method of cooling. This figure reveals that there are abnormalities at the top and the bottom respectively for 100m in case of Type I which employed usual cooling method. It will be understood from the figure that Types II and III cooled by T.B. NO SPRAY METHOD (This invention method) showed no irregularities or abnormalities. Other defects which are seen in respect of the WHOLE LENGTH NO SPRAY METHOD such as deformed coil, coarser hot rolled grains were not seen, either.

EXAMPLE 2

Experiments on the low carbon Al-killed steel were conducted. The making process employed comprised of slabbing — hot rolling — pickling — cold reducing — continuous annealing — temper rolling and the requirements of respective step were as follows.

Chemical composition of mother material

| C | Mn | P | S | Sol.Al | $N_2$ |
|---|---|---|---|---|---|
| 0.059 | 0.35 | 0.009 | 0.022 | 0.085 | 0.0053 |

| Hot rolling requirements | | | |
|---|---|---|---|
| Finishing temperature | 820 to 870° C | | |
| Coiling | Top (T) No spray length | Middle (M) coiling temp. | Bottom (B) No spray length |
| Type IV | 0 | 720° C | 0 |
| Type V | 40m | 710° C | 100m |
| Type VI | 100m | 710° C | 150m |

Type IV was coiled at a high temperature as in the usual method while Types V and VI employed T.B. NO SPRAY METHOD of this invention.

Finishing thickness: 2.3mm

Thickness after cold rolling: 0.6mm

Continuous annealing heat cycle 1. heating from the room temperature to 710° C
2. holding for 60 seconds at the said 710° C
3. rapid cooling from the said 710° C to 490° C at the average cooling rate of 35° C/sec
4. cooling from this 490° C to 400° C at the average cooling rate of 0.5° C/sec.
5. final cooling from the above 400° C to the room temperature at the average cooling rate of 5° C/sec.

Temper rolling: 0.8%

Figure 3:
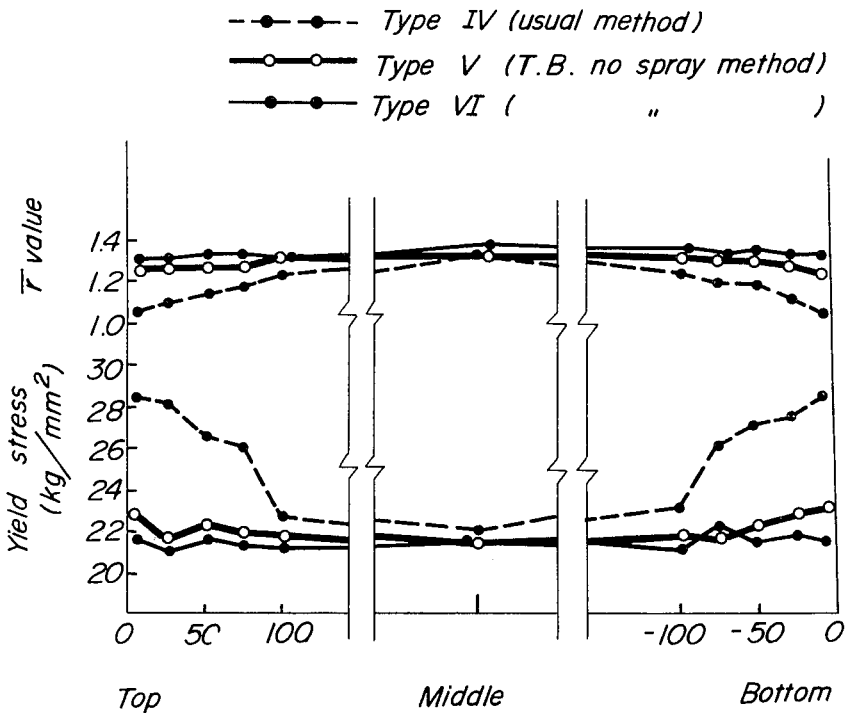
FIG. 3 shows a graph showing the relation between cooling methods and behavior of quality of a low carbon Al-killed steel strip end sides thereby.

FIG. 3 shows behaviour at the coil end sides under the said process and influence by the cooling method employed. According to the figure, the identical trends to that of the Example 1 given to low carbon capped steel are seen.

We claim:

1. In a continuous annealing process of making cold-reduced press-forming sheet of Al-killed, rimmed, silicon semi-killed or capped steel, the improvement of imparting uniform quality over the entire length of said steel sheet, comprising the steps of A. mounting said steel strip on a run-out table after hot rolling;

B. starting impinging water jet on said steel strip after said steel strip has travelled 20 to 200 meters;

C. stopping said water cooling before 20 to 200 meters of the end of said steel strip; and D. coiling the said strip at a temperature of more than 630° C, thereby to provide uniform self-annealing effect over the entire length of said strip, said process being characterized by the absence of any water being applied to either end of said sheet for a distance of 20 to 200 meters — has been inserted.

* * * * *